United States Patent [19]

Fassett

[11] Patent Number: 4,509,055

[45] Date of Patent: Apr. 2, 1985

[54] BLOCKAGE-FREE SPACE FED ANTENNA

[75] Inventor: Matthew Fassett, Billerica, Mass.

[73] Assignee: Raytheon Company, Lexington, Mass.

[21] Appl. No.: 431,899

[22] Filed: Sep. 30, 1982

[51] Int. Cl.[3] ..... H01Q 3/46

[52] U.S. Cl. ..... 343/754; 343/376; 343/756

[58] Field of Search ..... 343/754, 756, 376, 909

[56] References Cited

U.S. PATENT DOCUMENTS

| | | | |
|---|---|---|---|
| 3,836,976 | 9/1974 | Monser et al. | 343/795 |
| 4,010,471 | 3/1977 | Smith | 343/756 |
| 4,388,626 | 6/1983 | Gans | 343/754 |

*Primary Examiner*—Eli Lieberman

*Attorney, Agent, or Firm*—Philip J. McFarland; Joseph D. Pannone

[57] ABSTRACT

A space fed antenna with a folded path to reduce the distance between a phased array and the focal point of such array is shown to be made up of: (a) a first plurality of vertically polarized antenna elements incorporated in the phased array; (b) a second plurality of cross-polarized antenna elements disposed to form a polarization-twisting screen at a distance from the first plurality of vertically polarized antenna elements equal to one-third the focal length of such elements; and (c) a third plurality of latching circulators connected between selected pairs of cross-polarized antenna elements in the polarization-twisting screen so that such pairs also may function as a feed array for the space fed antenna.

5 Claims, 6 Drawing Figures

BLOCKAGE-FREE SPACE FED ANTENNA

BACKGROUND OF THE INVENTION

This invention pertains generally to optically fed antenna systems and in particular to an antenna of such type having a folded feed wherein aperture blockage is eliminated.

Optical or space feeds for lens array antenna systems are preferred in many applications because such feeds suffer significantly less loss than equivalent corporate feed networks and are less costly to build. Further, the relatively low weight of optically fed antenna systems makes such systems attractive for use in aircraft. However, in some applications (especially in aircraft installations) sufficient space is not always available to allow placement of the feed at the focal point of the array as is necessary for satisfactory operation. Consequently, only optically fed arrays with small focal length to diameter (F/D) ratios have been utilized in many applications. Unfortunately, with very small F/D ratio, the size of the nominal focal spot becomes very small. When the focal spot is small, good array illumination control is difficult to attain without intentionally moving the feed off the focal plane. An off focal plane feed may be just as effective as a focal plane feed in a monopulse antenna, provided both sum and difference main lobes are subtended over the frequency range of interest for the maximum scan condition of the main lens assembly. Unfortunately, however, an off focal plane feed greatly increases the complexity of the antenna system installation, especially in aircraft applications.

A known alternative to an off focal plane feed to mitigate the problems inherent with a small F/D ratio is a folded feed technique. The most effective feed using such a technique has "polarization-twist" elements to reduce the depth of the feed to one-third focal length. In such a folded feed, a horizontally-polarized multi-mode horn (or similar feed) is positioned in the center of a polarization-twisting surface. Vertically polarized energy incident on the outer face of vertically polarized antenna elements is passed to be incident on the polarization-twisting surface for conversion to horizontally polarized energy directed back toward such antenna elements for a final reflection back to the horizontally polarized multi-mode feed horn. While such an arrangement is effective in folding the optical path between antenna elements and feed, it suffers aperture blockage because the vertically polarized energy originally passed through the antenna elements and directly incident on the multi-mode feed horn is not polarization-twisted as required.

SUMMARY OF THE INVENTION

With the foregoing background of the invention in mind, it is, therefore, a primary object of this invention to provide an improved folded feed for an optically fed antenna, such feed introducing no aperture blockage.

The foregoing and other objects of this invention are generally attained by providing, within a folded optically fed antenna, a polarization twisting arry and an antenna feed array made up of similar arrays of so-called flared notch radiating elements, such elements being orthogonally disposed with respect to one another to provide either vertical or horizontal polarization. The elements in the polarization-twisting array are joined together to produce a reciprocal polarization twisting operation, while the elements in the antenna feed array are connected through latching circulators to combine the polarization twisting function as well as permit transmission and reception. Additionally, compensation is provided in each of the flared notch radiating elements in the polarization-twisting array to eliminate any differential time delay between such elements and the flared notch elements in the antenna feed array.

BRIEF DESCRIPTION OF THE DRAWINGS

Other objects and many of the attendant advantages of this invention will be readily appreciated as the same becomes better understood by reference to the following detailed description when considered in connection with the accompanying drawings wherein.

DESCRIPTION OF THE PREFERRED EMBODIMENT

Figure 1:
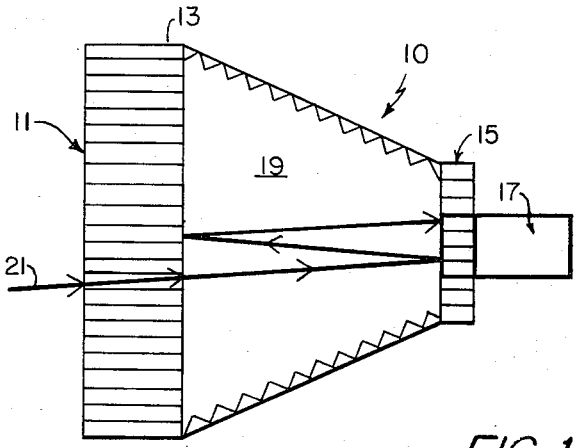
FIG. 1 is a sketch, somewhat simplified and in cross-section, of an optically fed planar array lens antenna employing the concepts of this invention.

Referring now to FIG. 1, an optically fed antenna 10 employing a folded feed according to this invention is shown to include a lens 11 having elements 13 (FIG. 2), a polarization-twisting array 15 and an antenna feed 17 disposed at the center of the polarization-twisting array 15. An anechoic chamber 19 is formed, as shown, by enclosing the space between the rear face (not numbered) of the lens 11 and the polarization-twisting array 15 in any conventional way to reduce sidelobes resulting from unwanted reflections. The focal length of the optically fed antenna 10 here is one-third the focal length of a conventional lens antenna system having a lens 11 of the same diameter because vertically polarized energy incident on the face of the lens 11 will be reflected two times in the anechoic chamber 19 before being passed through the antenna feed 17 to a radar receiver (not shown). That is to say, vertically polarized energy (such as that indicated by ray 21) that is incident on the face of the lens 11 will first be passed through the elements 13 to the polarization-twisting surface 15 for conversion to horizontally polarized energy and redirection back to the rear face of the lens 11 for reflection finally back to the antenna feed 17.

Figure 1A:
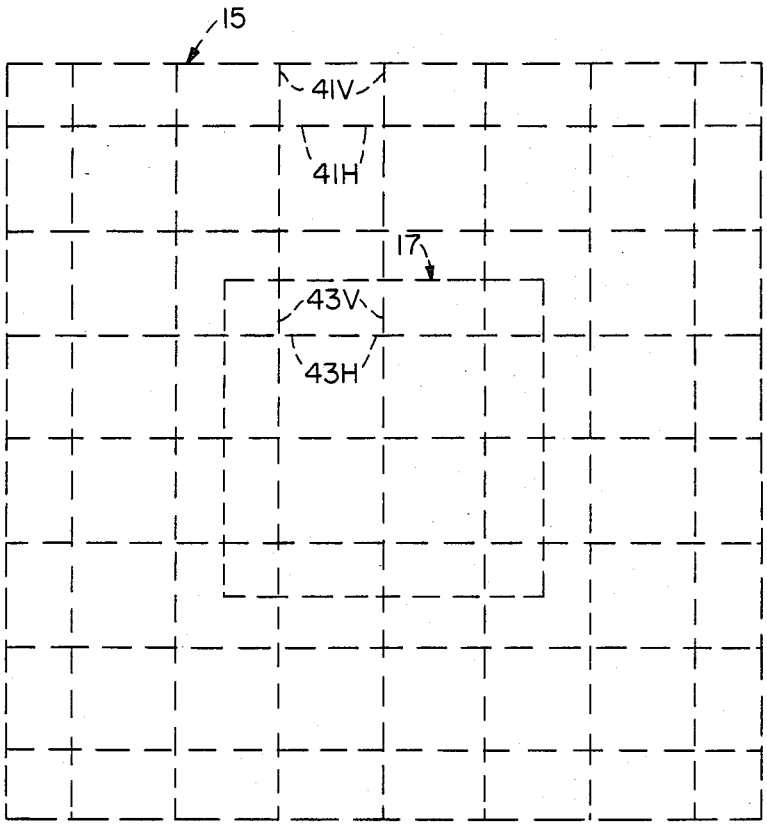
FIG. 1A is a sketch, in plan view, of the polarization twisting array and the feed array of the lens antenna of FIG. 1.

Referring now to FIG. 1A, it may be seen that the elements making up the polarization surface 15 and the antenna feed 17 of FIG. 1 are disposed to form a planar array in which the elements making up the antenna feed 17 are located centrally of the elements making up the polarization twisting surface 15.

Figure 2:
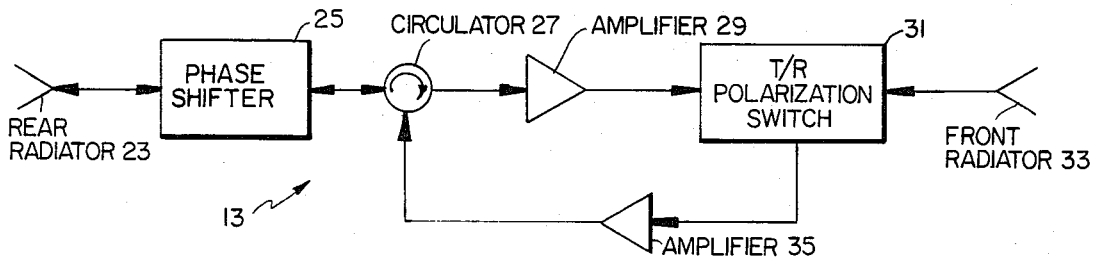
FIG. 2 is a block diagram of an exemplary one of the elements in the lens antenna of FIG. 1.

Referring now to FIG. 2, an element 13 of the lens 11 is shown to include a rear radiator 23 (which is vertically polarized), a reciprocal phase shifter 25, a circulator 27, a field effect transistor (FET) power amplifier 29, a combined transmit/receive (T/R) and polarization switch 31 and a front radiator 33 (dual polarized). In the receive mode, the T/R polarization switch 31 is effective to direct energy received by the dual polarized front radiator 33 (via a low noise FET amplifier 35, the circulator 27 and the reciprocal phase shifter 25) to the rear radiator 23. In the transmit mode, energy incident on the rear radiator 23 is passed (via the reciprocal phase shifter 25, the circulator 27, the FET amplifier 29 and the T/R polarization switch 31) to the front radiator 33. It should be noted here in passing that the impedance match of the rear radiator 23 to the anechoic chamber 19 (FIG. 1) becomes a consideration at the F/D ratio here achievable because any substantial mismatch may represent a substantial loss of power. Fortunately, because the array element 13 is an active device, loss of power is not a severe limitation. Further, the anechoic chamber 19 (FIG. 1) between the rear face of the lens 11 (FIG. 1) and the polarization-twisting array 15 (FIG. 1) assures that stray energy reflected from the rear face of the lens 11 (FIG. 1) will be well terminated, thereby avoiding the creation of regions of high sidelobes due to multiple reflections between the polarization-twisting array 15 (FIG. 1) and the rear face of the lens 11 (FIG. 1).

Figure 3B:
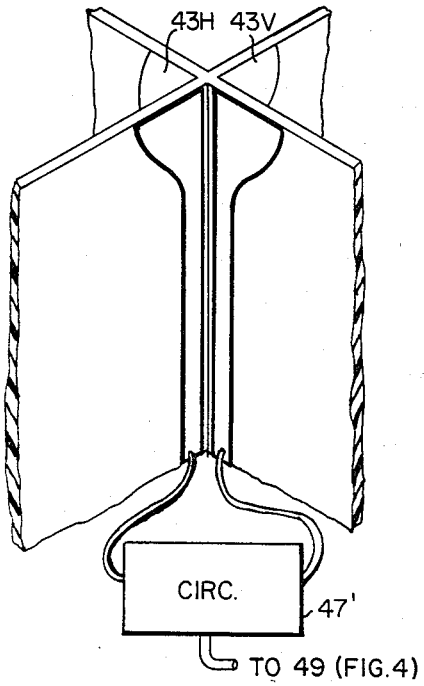
FIGS. 3A and 3B are partial isometric views of the polarization twisting array and feed array, respectively, of the lens antenna of FIG. 1.
Figure 3A:
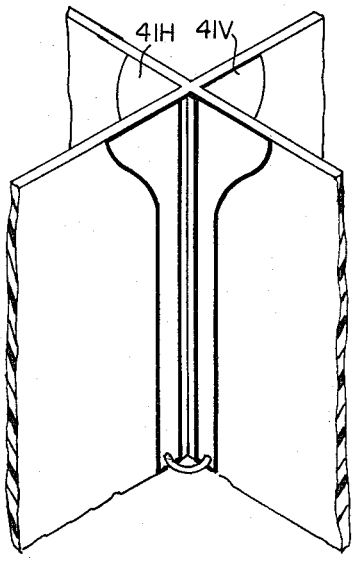

Referring now to FIG. 3A, each element of the polarization-twisting array 15 is shown to be made up of a horizontally polarized stripline flared notch radiator 41H and an orthogonally disposed, vertically polarized stripline flared notch radiator 41V. Such radiators, as well as the construction of an "egg-crate" array of such radiators, are described in detail in U.S. Pat. No. 3,836,976 issued Sept. 17, 1974, inventors George J. Monser et al, and assigned to the same assignee as the present invention. The feeds (not shown) for contiguous pairs of horizontally and vertically polarized radiators 41V, 41H are connected together to provide the polarization-twisting function. Thus, in the receive mode, vertically polarized energy received by the radiator 41V is passed directly to radiator 41H from which it is radiated as horizontally polarized energy. In the transmit mode, the converse holds. That is to say, horizontally polarized energy transmitted by the antenna feed 17 (FIG. 1) is reflected by the rear face of the lens 11 back to the horizontally polarized elements 41H. The energy received by such elements is retransmitted as vertically polarized energy from radiators 41V. Such vertically polarized energy traverses the vertically polarized rear radiator 23 (FIG. 2) of the array element 13 (FIG. 2) to be phase shifted, amplified and retransmitted. It should be noted here in passing that if time delay focusing of the energy from the polarization-twisting array 15 were desired, that function could be provided by controlling the electrical length of the interconnection between the feeds of the contiguous horizontally and vertically polarized elements 41H, 41V.

Figure 4:
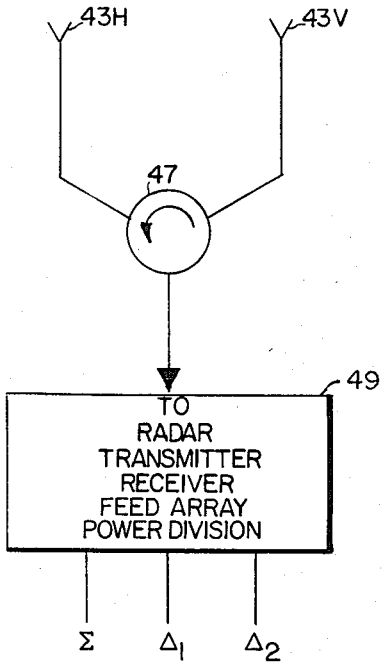
FIG. 4 is a schematic representation illustrating the interconnection between the antenna feed elements of the lens antenna of FIG. 1.

Referring now to FIGS. 3B and 4, an exemplary one of the antenna feed array elements is shown to be comprised of a pair of orthogonally disposed flared notch radiators 43H, 43V connected together through a latching circulator 47. The latter is provided to interface the feed element with either a transmitter or receiver (neither of which is shown), while still providing the polarization-twisting function. That is to say, with the sense of the latching circulator 47 as shown, vertically polarized energy incident on radiator 43V will be passed to radiator 43H. Horizontally polarized energy from radiator 43H will then be reflected from the rear face of the lens 11 (FIG. 1) back to radiator 43H and then passed via the latching circulator 47 and a T/R switch 49 to a radar receiver (also not shown). In the transmit mode, the sense of the latching circulator 47 must be reversed so that the energy radiated from the feed element will be initially horizontally polarized as required for proper operation of the folded feed system. The sense of the latching circulator 47 may be reversed by simply reversing the applied magnetic field. As mentioned briefly hereinabove, the provision of the latching circulator in the feed elements allows the latter to retain their polarization-twisting capability, thereby eliminating the aperture blockage problems in prior art folded feeds employing polarization-twisting techniques.

It should now be appreciated that compensation for the differential time delay between the feed elements and the elements (not numbered) of the polarization-twisting surface 15 (FIG. 2) resulting from the inclusion of the latching circulator 47 in the former must be provided. Such compensation may simply be in the form of an additional length of line between the orthogonally disposed contiguous horizontally and vertically polarized radiators 41H, 41V forming each of the passive radiating elements.

Referring back now for a moment to FIG. 1, it is noted that in an X-band application a 30 inch diameter lens 11 was comprised of 1,605 elements 13 and the antenna feed 17 was comprised of 31 feed elements (FIG. 4).

Having described a preferred embodiment of the invention, it will now be apparent to one of skill in the art that many changes may be made without departing from the inventive concepts disclosed. Thus, for example, the latching circulator 47 (FIG. 4) provided between the horizontally and vertically polarized radiators 43H, 43V, respectively of the feed element may be replaced with a conventional circulator and a transfer switch to reverse the sense between transmit and receive modes. It is felt, therefore, that this invention should not be restricted to its disclosed embodiment, but rather should be limited only by the scope of the appended claims.

What is claimed is:

1. A space fed antenna comprising:

(a) a first planar array of vertically-polarized antenna elements having a predetermined focal length;

(b) a second planar array of pairs of cross-polarized antenna elements parallel to the first planar array at a distance equal to one-third the focal length of the first planar array, such second planar array having peripherally located pairs of elements and centrally located pairs of elements; and (c) means for connecting the elements in each one of the pairs of cross-polarized antenna elements to form a polarization-twisting screen from the peripherally located ones of such pairs and a combined polarization-twisting array and feed from the centrally located ones of such pairs.

2. The antenna as in claim 1 wherein, in the second planar array, the number of centrally located pairs of cross-polarized antenna elements is substantially less than the number of periphally located pairs of vertically polarized antenna elements.

3. The antenna as in claim 2 wherein the means for connecting the elements in the centrally located pairs of cross-polarized antenna elements comprises a latching circulator disposed between the elements in each pair of such elements.

4. The antenna as in claim 3 wherein the means for connecting the elements in the peripherally located pairs of cross-polarized antenna elements comprises a length of transmission line having a phase delay equal to the phase delay in each latching circulator.

5. The antenna as in claim 4 having, additionally, an energy absorbing material disposed about edges of the first and second planar antenna to define an enclosure between such arrays.

* * * * *